US012595632B2

(12) United States Patent
Krogmann et al.

(10) Patent No.: US 12,595,632 B2
(45) Date of Patent: Apr. 7, 2026

(54) SNOW AND ICE SPREADER AND SPRAYER

(71) Applicant: Douglas Dynamics LLC, Milwaukee, WI (US)

(72) Inventors: Jeffrey Michael Krogmann, Manchester, IA (US); Christoper Steven Maury, Manchester, IA (US)

(73) Assignee: Douglas Dynamics LLC, Milwaukee, WI (US)

( * ) Notice: Subject to any disclaimer, the term of this patent is extended or adjusted under 35 U.S.C. 154(b) by 260 days.

(21) Appl. No.: 18/462,834

(22) Filed: Sep. 7, 2023

(65) Prior Publication Data

US 2025/0084602 A1 Mar. 13, 2025

(51) Int. Cl.
*E01H 10/00* (2006.01)

(52) U.S. Cl.
CPC ..... *E01H 10/007* (2013.01)

(58) Field of Classification Search
CPC ..... E01H 10/007
See application file for complete search history.

(56) References Cited

U.S. PATENT DOCUMENTS 5,964,410 A * 10/1999 Brown ..... B05B 13/005 239/447
6,446,879 B1 * 9/2002 Kime ..... E01C 19/203 239/7
2004/0124260 A1 7/2004 Ward et al.
2004/0195357 A1 * 10/2004 Doherty ..... B60T 8/172 239/172
2012/0056011 A1 3/2012 Hollinrake et al.
2020/0298261 A1 * 9/2020 Mäenpää ..... B05B 13/005

FOREIGN PATENT DOCUMENTS

DE 4125965 A1 * 4/1992 ..... E01H 10/007
DE 202017100804 U1 * 2/2017 ..... E01H 10/007
EP 579311 A1 * 4/1992 ..... E01H 10/007
KR 102534887 B1 * 5/2023 ..... B65G 65/46
WO WO-03004778 A1 * 1/2003 ..... E01H 10/007
WO WO-2017055640 A1 * 4/2017 ..... E01H 10/007

OTHER PUBLICATIONS

Highway Equipment Company, Inc., d/b/a/ New Leader Manufacturing; Product Brochure for Xzalt Precision Applicator; (c) 2023.
Swenson, a brand of Aebi Schmidt; Product Brochure for EVolution Smart Spreader, printed Dec. 6, 2023 from swensonproducts.com.
Schmidt, a brand of Aebi Schmidt; Product Brochure for Stratos; document created Aug. 11, 2023.

(Continued)

*Primary Examiner* — Darren W Gorman
(74) *Attorney, Agent, or Firm* — Wood Herron & Evans LLP

(57) ABSTRACT

A snow and ice control spreader and sprayer comprises a granular material hopper, a granular material delivery system, at least first and second liquid tanks mounted on both sides of the hopper, the first tank having a first volume and the second tank having a second volume, the first volume being greater than the second volume, a liquid delivery system, and a manifold.

29 Claims, 9 Drawing Sheets

(56) References Cited

OTHER PUBLICATIONS

Epoke North American Inc.; Product Brochure for Bulk Speaders, specifically p. 5, 4900 AST COMBI and 4902 AST COMBI-High Speed; printed Dec. 6, 2023 from www.epokena.com.
Monroe Municipal Truck Equipment; Product Brochure for V-Box Spreaders, specifically p. 6, Spreader/Combination Units; Oct1-V1; printed Dec. 6, 2023 from municipal.monroetruck.com.
Henderson Products, Inc.; Product Brochure for First Response(R); HP-050 Jun. 2020.
Henderson Products, Inc.; Product Brochure for Task Force(R); HP-051 May 2020.

* cited by examiner

SNOW AND ICE SPREADER AND SPRAYER

RELATED APPLICATIONS

N/A.

FIELD OF THE INVENTION

This invention relates generally to snow and ice control equipment, and more particularly to spreaders and sprayers.

BACKGROUND OF THE INVENTION

A typical truck mounted combination granular material spreader and liquid sprayer comprises a granular material storage hopper, a granular material delivery system, two liquid storage tanks, one on either side of the hopper, and a liquid delivery system. The truck may be a dump truck, a flat bed truck, or a pick-up truck. The granular material delivery system may be an auger drive or chain drive that conveys the granular material from the hopper to a spinner which broadcasts the granular material onto the road surface. The granular material may be ice melting material, sand, or other substances. The liquid delivery system may be a pump and associated tubing which pumps the liquid from the tank to a spray boom which sprays the liquid onto the road surface. The liquid may be salt brine, calcium chloride, magnesium chloride, or other substances.

A typical spreader/sprayer ranges in length from 10 feet to 16 feet, in one foot increments. Currently a single tank is mounted on either side of the hopper, in the same length as the spreader/sprayer. Consequently, this results in seven possible lengths of tanks, requiring seven different molds from which to manufacture the tanks.

It is desirable to reduce the number of molds required to produce tanks for spreaders/sprayers that range in length from 10 feet to 16 feet, in one foot increments, while ensuring efficient usage of total tank volume, weight distribution balance of the tanks, and filling and emptying of the tanks in an equal and balanced manner.

SUMMARY OF THE INVENTION

In one aspect, a snow and ice control spreader and sprayer comprises a granular material hopper, a granular material delivery system, at least first and second liquid tanks mounted on both sides of the hopper, the first tank having a first volume and the second tank having a second volume, the first volume being greater than the second volume, a liquid delivery system, and a manifold. The manifold comprises a housing having an inlet for filling the tanks and an outlet for emptying the tanks, the outlet fluidically connected to the liquid delivery system. The housing has a first pair of first and second fittings, the first fitting of the first pair fluidically connected to the first tank on one side of the hopper and the second fitting of the first pair fluidically connected to the second tank on the one side of the hopper. The housing has a second pair of the first and second fittings, the first fitting of the second pair fluidically connected to the first tank on the other side of the hopper and the second fitting of the second pair fluidically connected to the second tank on the other side of the hopper. The first fittings of the first and second pairs each have a first orifice, and the second fittings of the first and second pairs each have a second orifice. The second orifice is smaller than the first orifice.

The granular material delivery system can comprise an auger drive or a chain drive that conveys the granular material from the hopper to a spinner which broadcasts the granular material onto a road surface.

The liquid delivery system can comprise a pump and associated tubing which pumps the liquid from the tanks to a spray boom which sprays the liquid onto a road surface.

The housing can include a diverter between the inlet and the outlet for directing liquid from the inlet to the fittings.

The first tank can have a length of 4 feet and the second tank can have a length of 3 feet, with the first and second tanks having the same width and depth.

The second orifice can be defined by a washer positioned in each of the second fittings.

The first and second tanks on the one side of said hopper can be fluidically connected and the first and second tanks on the other side of the hopper can be fluidically connected.

The first and second tanks on both sides of the hopper can be vented to atmosphere.

The manifold can be positioned mid-length and mid-width of the spreader and sprayer.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
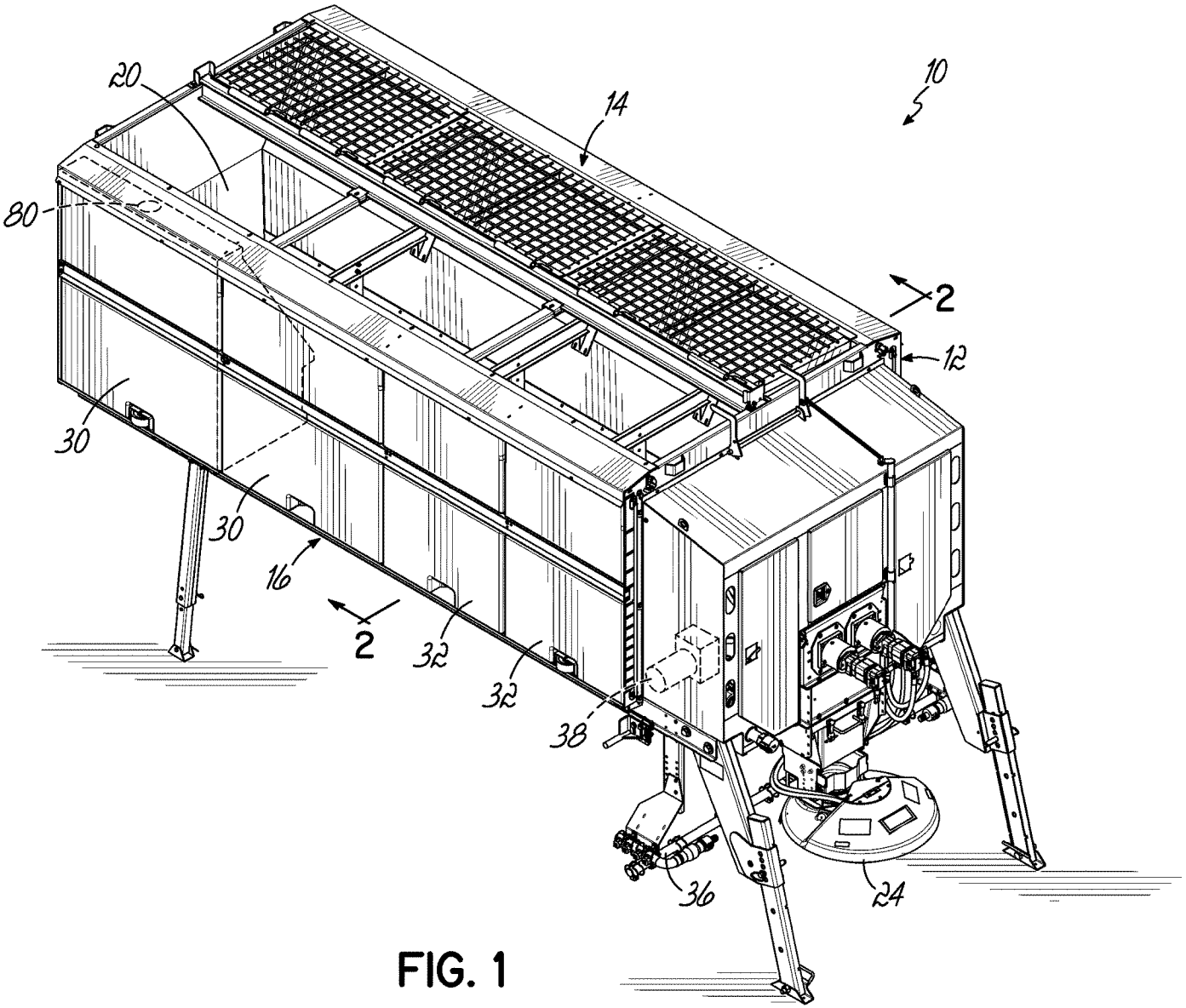
FIG. 1 is a top, left, rear perspective view of the spreader/sprayer of the present invention.
Figure 2:
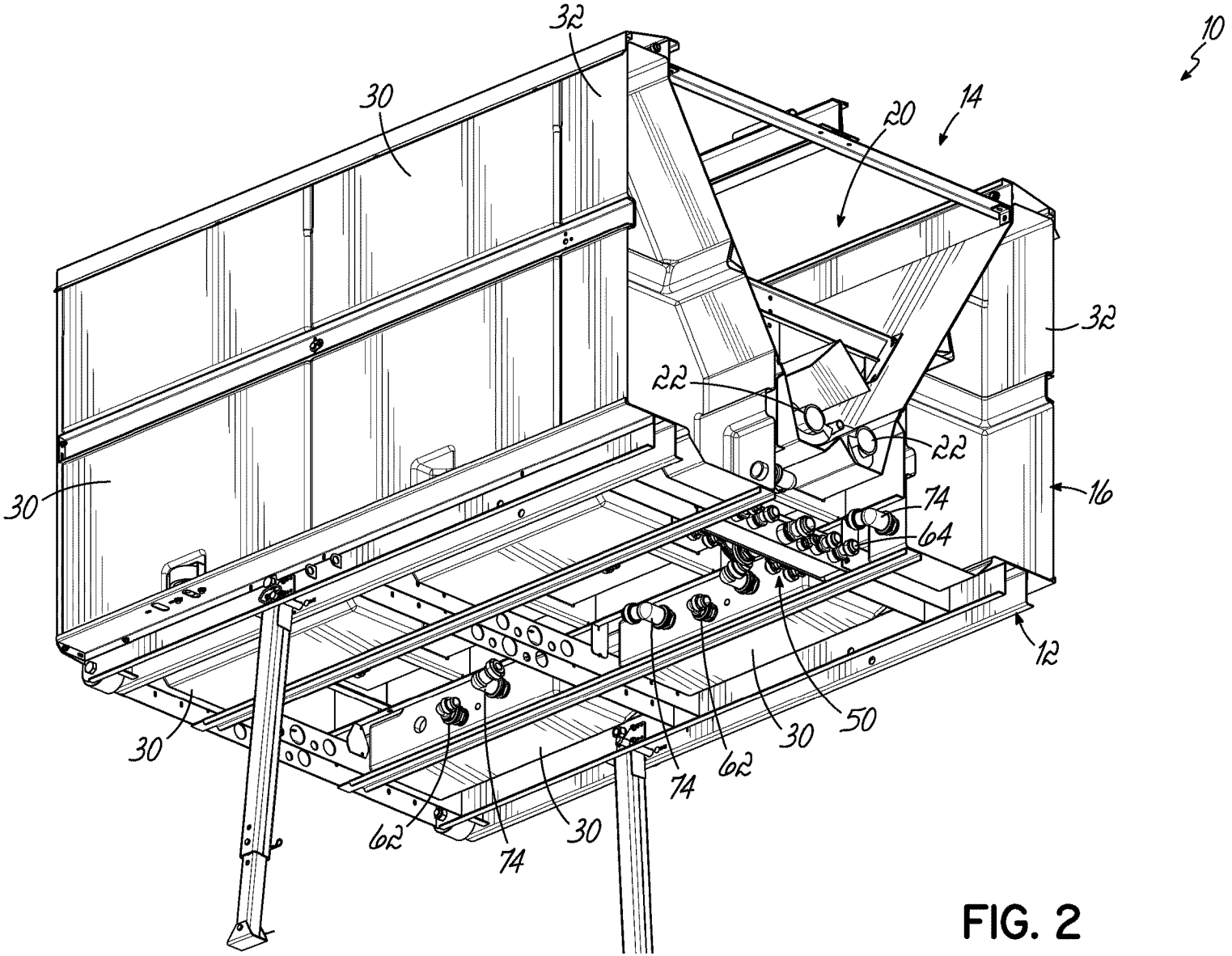
FIG. 2 is a cross-sectional view taken along line 2-2 in FIG. 1.
Figure 3:
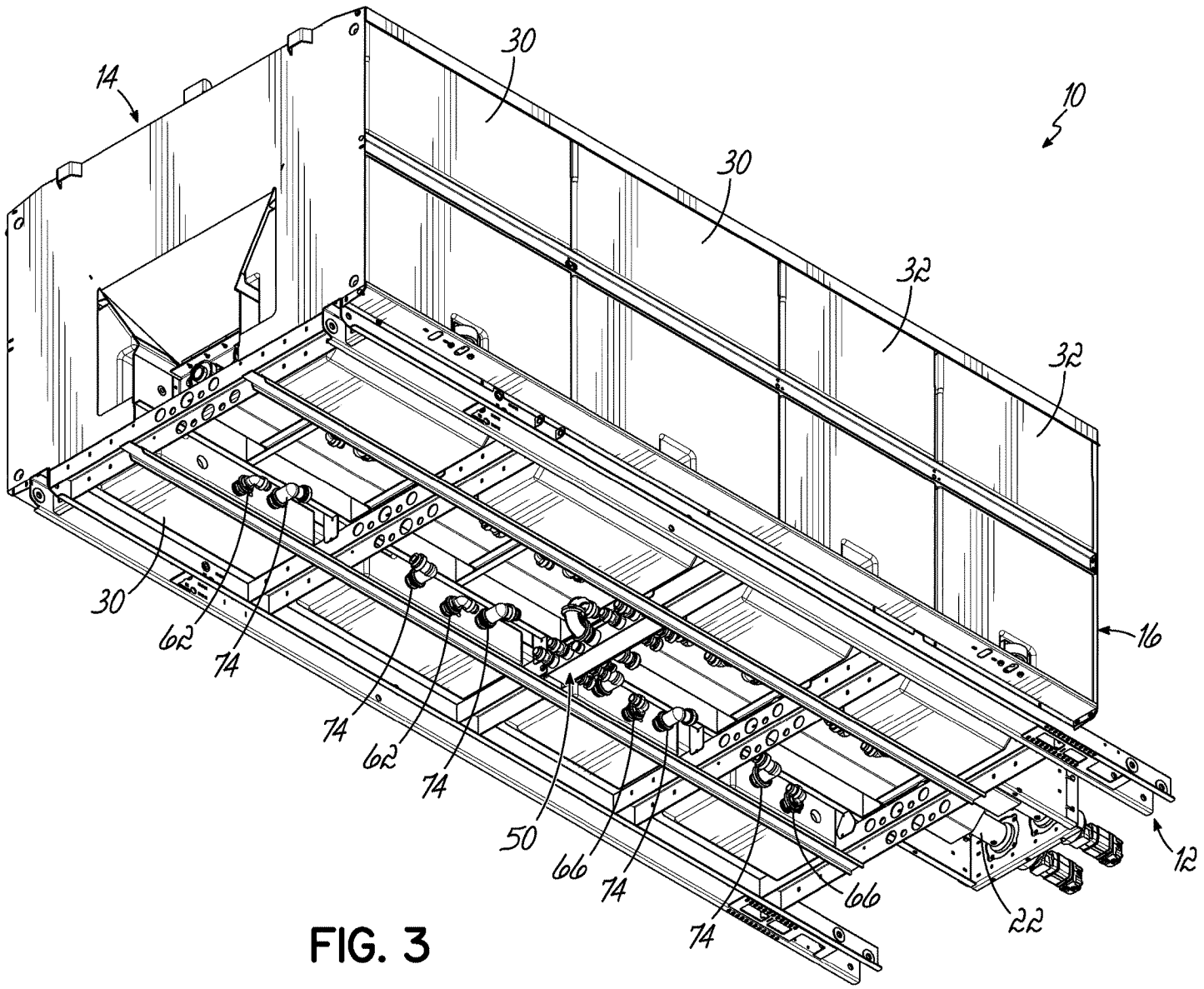
FIG. 3 is a bottom, left, front perspective view of the spreader/sprayer.

Referring first to FIGS. 1-3, there is illustrated and spreader and sprayer 10 according to the principles of the present invention. The spreader/sprayer 10 has a frame 12 that supports a granular material storage and delivery system 14 and a liquid storage and delivery system 16.

The granular material storage and delivery system 14 comprises a hopper 20, one or more motorized augers 22, and a motorized spinner 24. The augers 22 convey the granular material from the hopper 20 to the spinner 24 which broadcasts the granular material onto the road surface. Alternatively, a pintle chain drive can be used in lieu of the augers to convey the material from the hopper 20 to the spinner 24. The spinner 24 can include a pre-wet assembly to pre-wet the granular material.

The liquid storage and delivery system 16 comprises at least two brine storage tanks 30, 32 mounted on each side of the hopper 20, a spray boom 36, and a pump 38 and associated tubing which pumps the brine from the tanks 30, 32 to the spray boom 36 which sprays the brine onto the road surface. Brine from the tanks is also supplied to the aforementioned pre-wet assembly associated with the spinner 24 via a pre-wet assembly pump and associated tubing, provided the spinner 24 is outfitted with such a pre-wet assembly. Depending on the length of the spreader/sprayer 10, more than two tanks per side may be utilized, as described below.

Additional details of spreaders/sprayers of the type described herein may be seen with reference to the assignee's US Patent Publication No. 2004/0124260 for APPARATUS FOR TREATMENT OF SNOW AND ICE and US Patent Publication No. 2012/0056011 for SNOW AND ICE CONTROL EQUIPMENT FRAME, both of which are hereby incorporated by reference herein as if fully set forth in their entirety.

Figure 4:
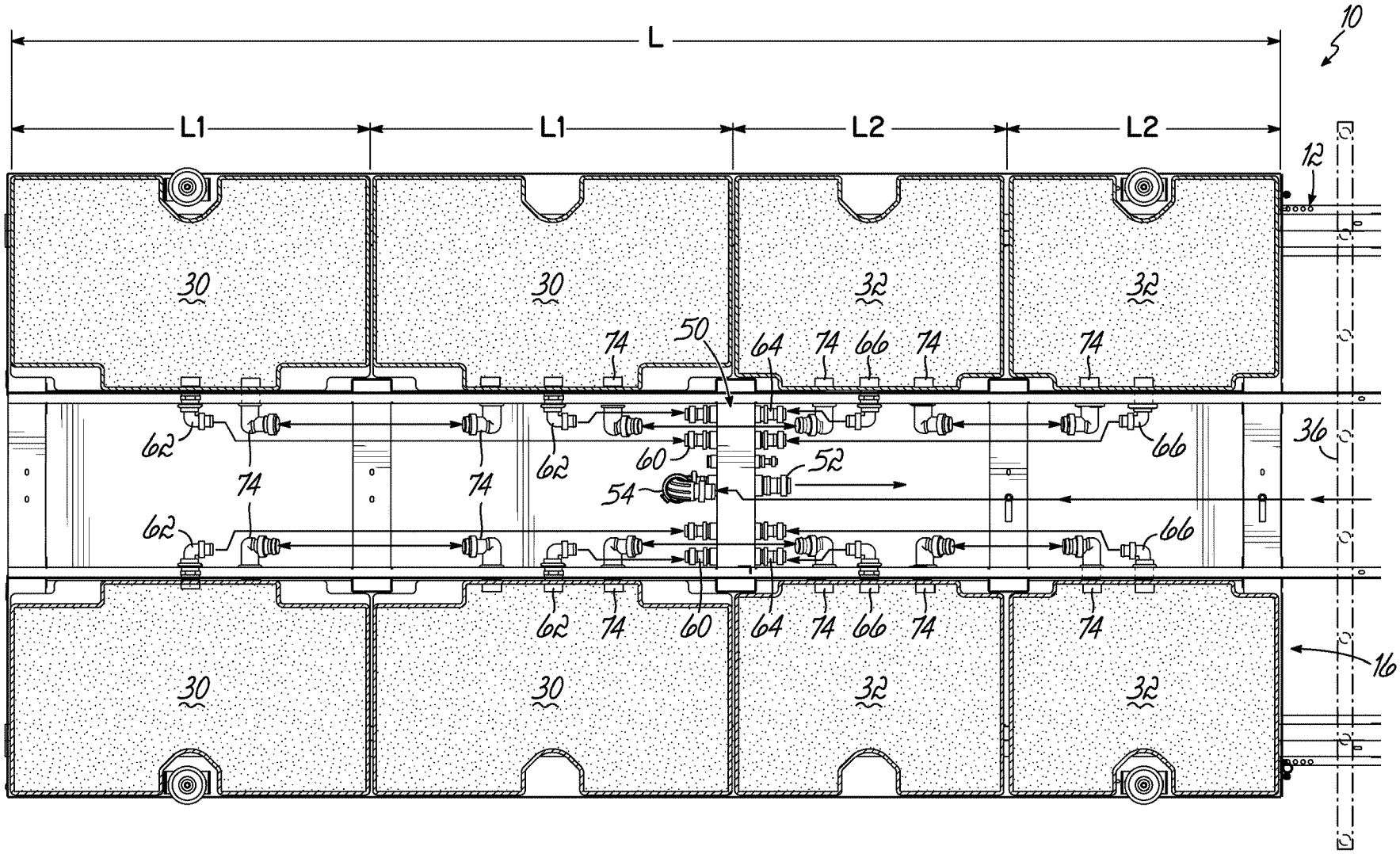
FIG. 4 is a top view of the spreader/sprayer.
Figure 5A:
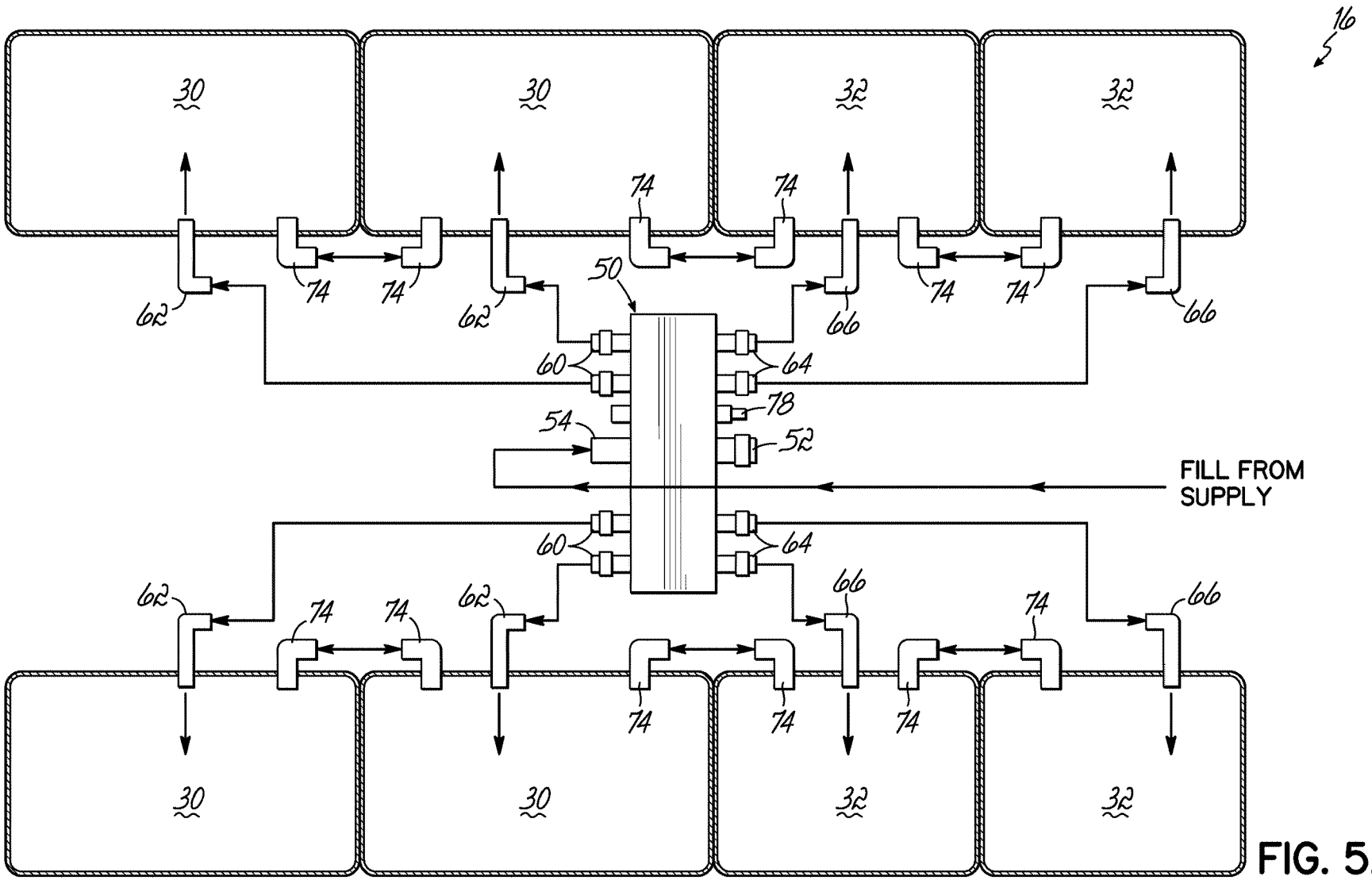
FIG. 5A is a flow diagram during the filling operation.
Figure 5B:
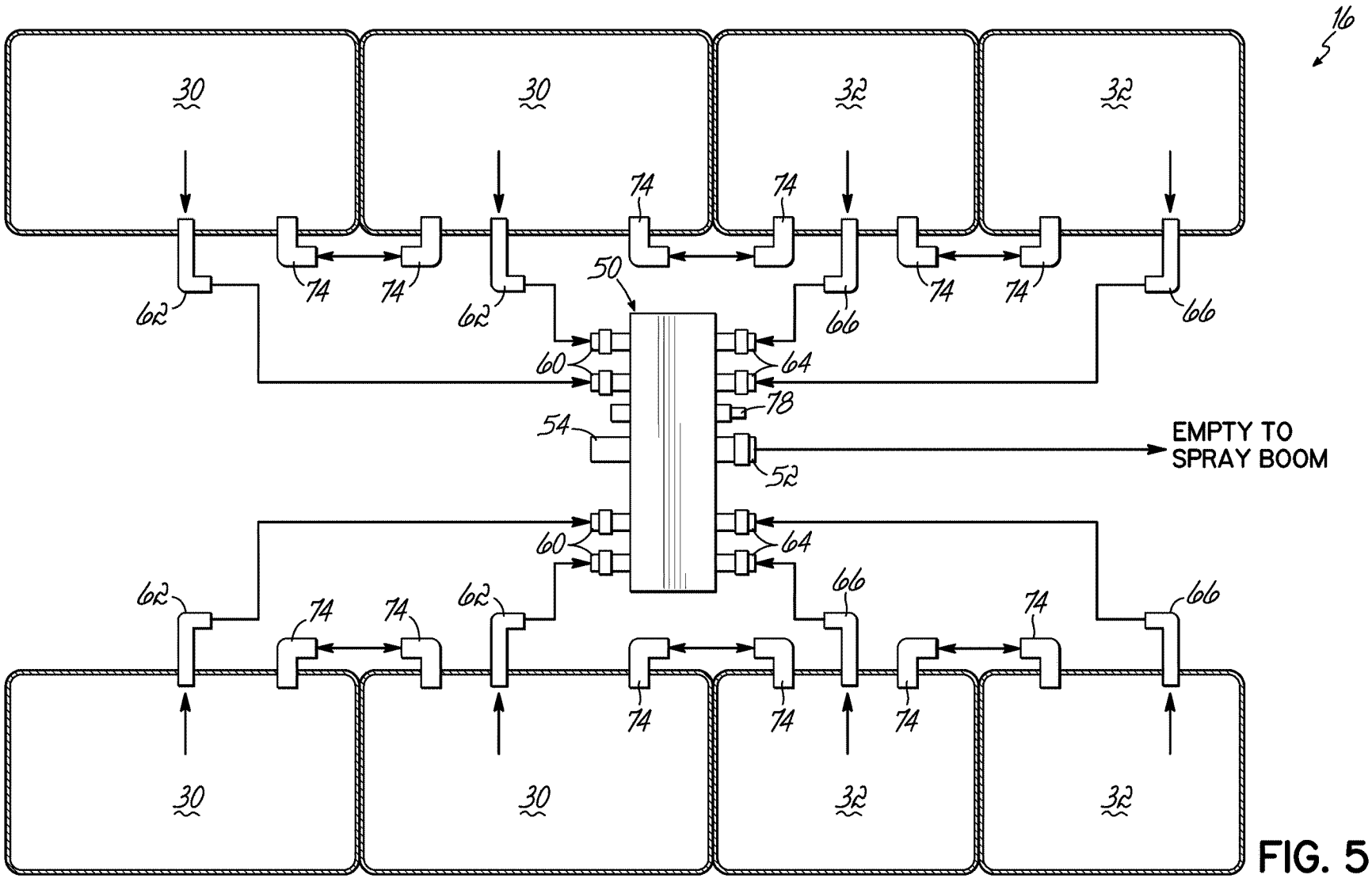
FIG. 5B is a view similar to FIG. 5A but during the spraying operation.
Figure 6:
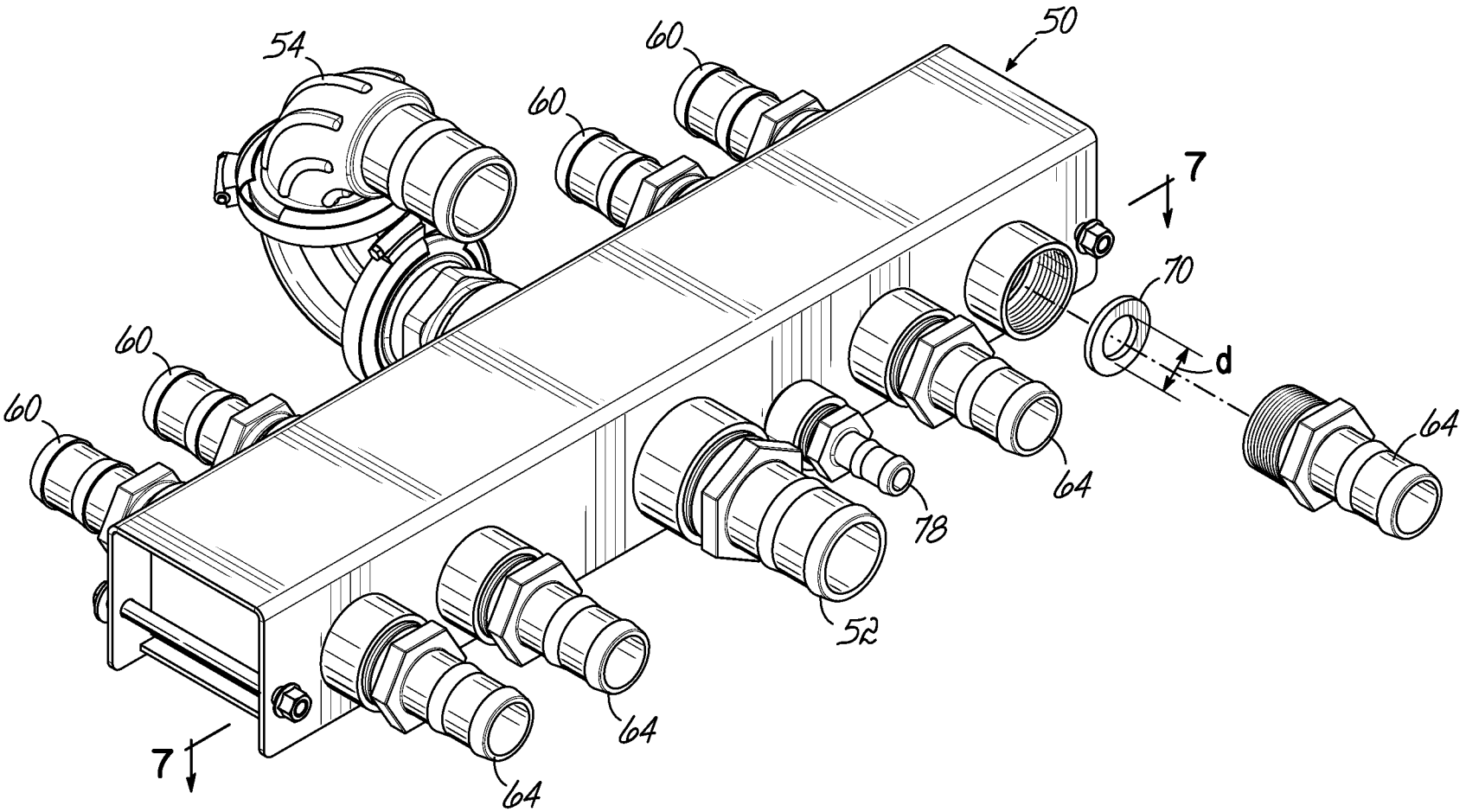
FIG. 6 is a top, left, rear perspective view of the manifold of the spreader/sprayer.

Referring now to FIGS. 4-6, it was discovered that various combinations of two different tank lengths L1 and L2 can produce total tank lengths L ranging from 10 feet to 16 feet in one foot increments, where L1=4 feet and L2=3 feet. The illustrated spreader/sprayer 10 is a 14 foot model. For this length spreader/sprayer, two 4 foot long tanks 30 and two 3 foot long tanks 32 are selected and mounted on each side of the spreader/sprayer 10, in order to produce a total tank length per side of 14 feet. The tanks 30 and 32, while having different lengths, have substantially the same width, depth, and cross-sectional profile.

However, it was also discovered that tanks of differing lengths, and hence differing volumes, do not fill and drain in an equal or balanced manner. The three foot long tanks will fill and drain before the four foot long tanks fill and drain. This results in inefficient usage of total tank volume, weight distribution imbalance of the tanks, and filling and emptying of the tanks in an unequal and unbalanced manner.

To remedy this, a common manifold 50 is mounted to the frame 12 centrally of the length and width of the tanks 30, 32 and beneath the tanks 30, 32, and serves as a common filling and emptying point for all the tanks 30, 32. The manifold 50 includes a filling port or fitting 54 for receiving brine from a supply to fill the tanks 30, 32, and an emptying port or fitting 52 for sending brine from the tanks 30, 32 to the spray boom 36.

The manifold 50 includes a main chamber 51 and four ports or fittings 60, each of which is fluidically connected to one of the four tanks 30 via a port or fitting 62 of the tank 30. Similarly, manifold 50 includes four ports or fittings 64, each of which is fluidically connected to one of the four tanks 32 via a port or fitting 66 of the tank 32. As best shown in FIG. 6, the ports or fittings 64 are each outfitted with a washer 70 having an internal diameter d. The ports or fittings 60 are not so outfitted. Thus, ports or fittings 64 have a reduced diameter and hence smaller orifice size, as compared to the diameter and orifice size of ports or fittings 60. The washers 70 act as flow restrictors, the size of which (internal diameter d) is selected such that the tanks 30, 32 will fill and empty in an equal and balanced manner. In other words, as the tanks 30, 32 are filled via fill port 54, the tanks 32 will reach full capacity at the same time as tanks 30 reach full capacity. Similarly, as the tanks 30, 32 are emptied via empty port 52, the tanks 32 will reach empty capacity at the same time as tanks 30 reach empty capacity.

In order to provide further liquid balance amongst the tanks 30, 32, adjacent ones of the tanks are fluidically connected via fittings 74. To prevent a vacuum from forming in the tanks 30, 32 as the pump 38 pumps the brine to the spray boom 36, one or more vent holes 80 (only one shown in FIG. 1) can be provided in the upper surface of each tank 30, 32.

Figure 7A:
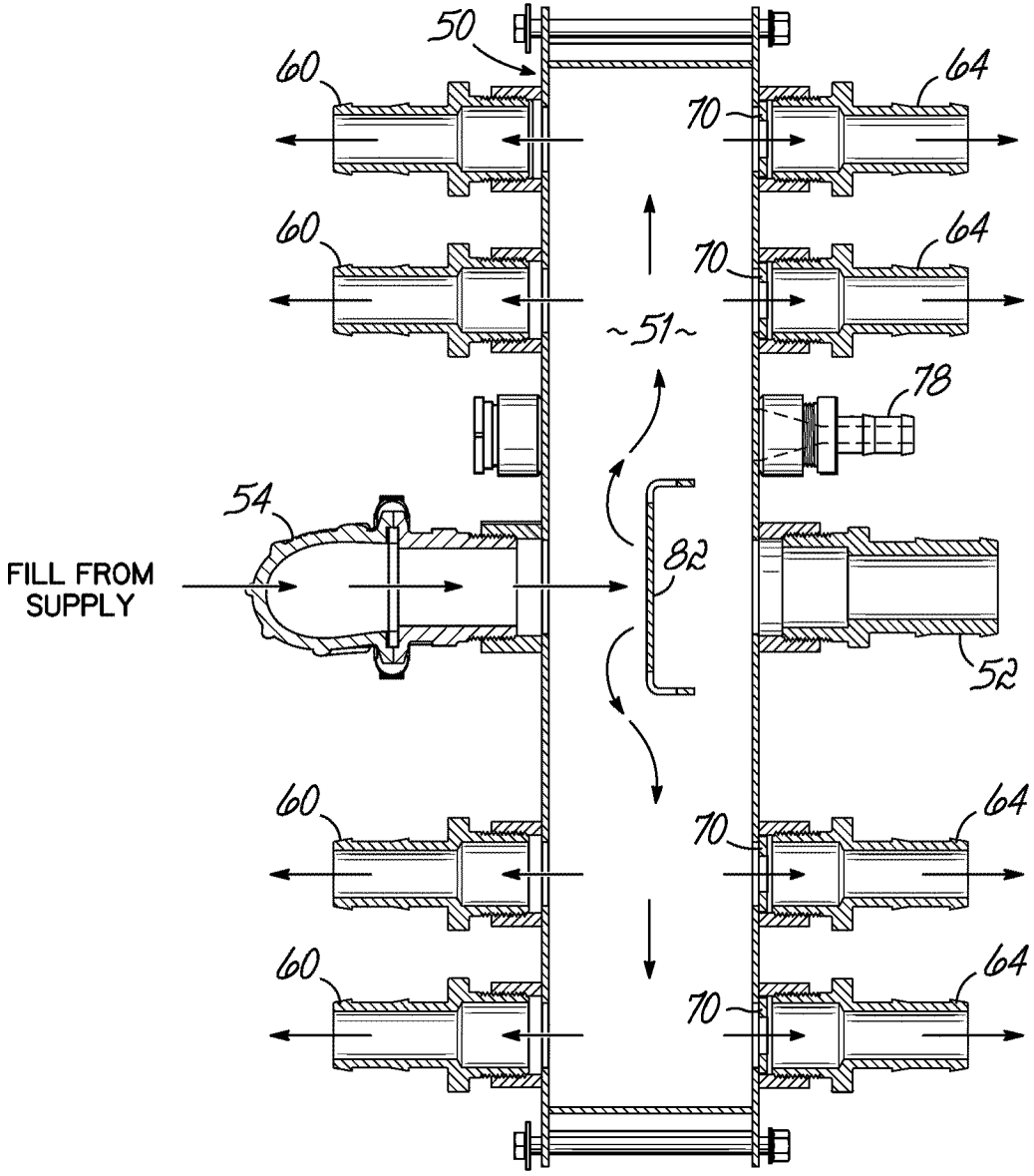
FIG. 7A is a cross-section view taken along line 7-7 in FIG. 6 during the filling operation.
Figure 7B:
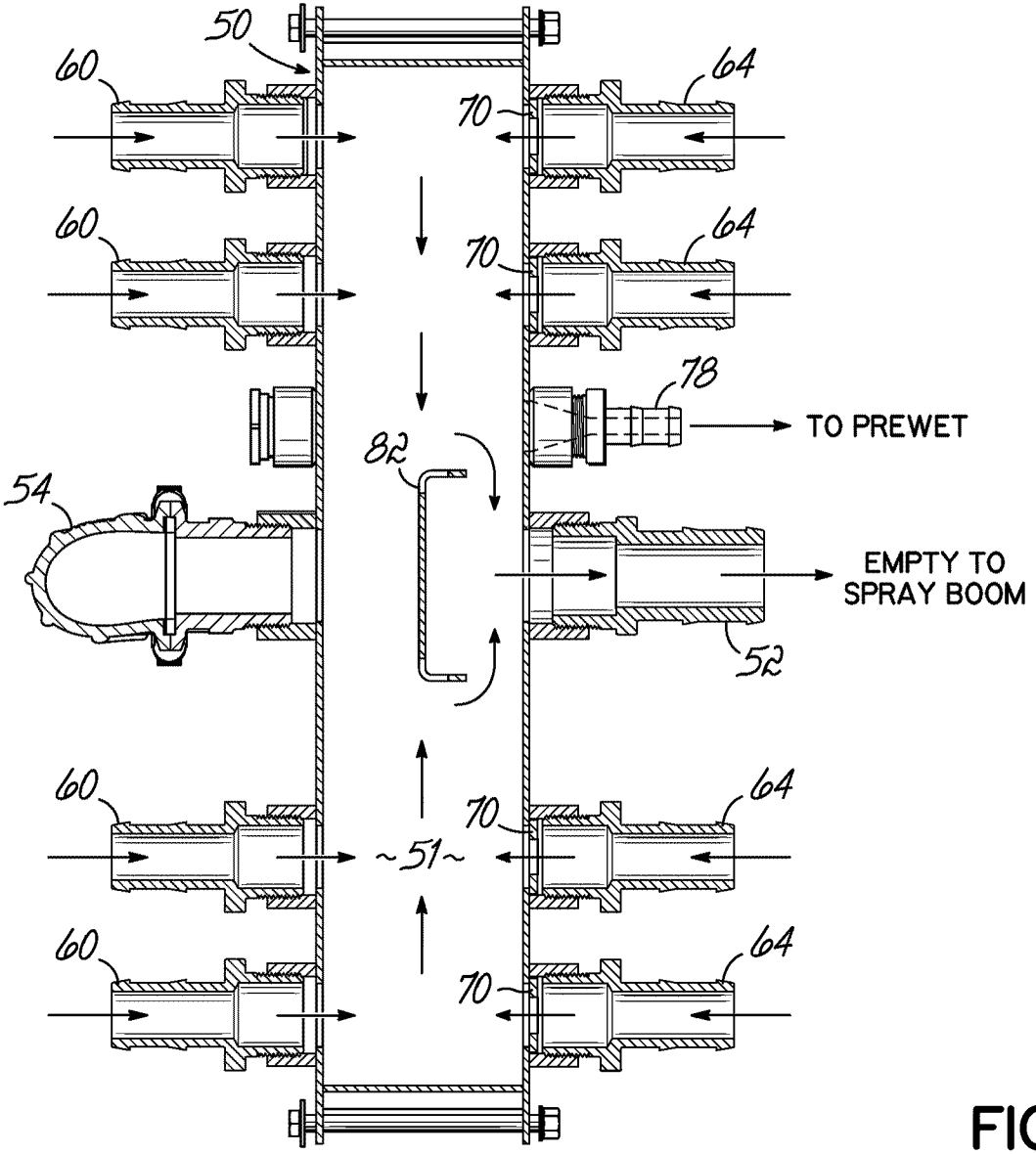
FIG. 7B is a view similar to FIG. 7A but during the spraying operation.

Referring now to FIGS. 6-7B, it will be seen that manifold 50 is essentially an elongated rectangular in cross-section box, oriented transversely to the longitudinal axis of the spreader/sprayer 10, and including the aforementioned ports or fittings 52, 54, 60, and 64. An additional port or fitting 78 is fluidically connected to the pre-wet assembly associated with the spinner 24. As shown in FIG. 7A, manifold 50 includes a diverter 82 which is generally vertically oriented and generally channel shaped when viewed in horizontal cross-section. The web of the channel shaped diverter 82 faces fill port 54 (the flanges of the channel shaped diverter 82 face the empty port 52) and serves to divert liquid flow from the fill port 54 towards the ports/fittings 60 and 64, thus preventing liquid flow from entering main chamber 51 from the fill port 54 and then immediately exiting the main chamber 51 via empty port 52.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in any and all combinations and subcombinations of any and all of those features. Accordingly, the scope of the invention shall be limited only by the following claims and their equivalents.

The invention claimed is:

1. A snow and ice control spreader and sprayer comprising:

a granular material hopper, a granular material delivery system, at least first and second liquid tanks mounted on both sides of said hopper, said first tank having a first volume and said second tank having a second volume, said first volume being greater than said second volume, a liquid delivery system, and a manifold comprising:

a housing, said housing having an inlet for filling the tanks and an outlet for emptying the tanks, said outlet fluidically connected to said liquid delivery system, and said housing having a first pair of first and second fittings, said first fitting of said first pair fluidically connected to said first tank on one side of said hopper and said second fitting of said first pair fluidically connected to said second tank on said one side of said hopper, and said housing having a second pair of said first and second fittings, said first fitting of said second pair fluidically connected to said first tank on the other side of said hopper and said second fitting of said second pair fluidically connected to said second tank on said other side of said hopper, said first fittings of said first and second pairs each having a first orifice, said second fittings of said first and second pairs each having a second orifice, said second orifice being smaller than said first orifice.

2. The spreader and sprayer of claim 1 wherein said granular material delivery system comprises an auger drive or a chain drive that conveys the granular material from said hopper to a spinner which broadcasts the granular material onto a road surface.

3. The spreader and sprayer of claim 1 wherein said liquid delivery system comprises a pump and associated tubing which pumps the liquid from said tanks to a spray boom which sprays the liquid onto a road surface.

4. The spreader and sprayer of claim 1 wherein said housing includes a diverter between said inlet and said outlet for directing liquid from said inlet to said fittings.

5. The spreader and sprayer of claim 1 wherein said first tank has a length of 4 feet and said second tank has a length of 3 feet, and wherein said first tank and said second tank have the same width and depth.

6. The spreader and sprayer of claim 1 wherein said second orifice is defined by a washer positioned in each of said second fittings.

7. The spreader and sprayer of claim 1 wherein adjacent ones of said first and second tanks on said one side of said hopper are fluidically connected to each other and adjacent ones of said first and second tanks on said other side of said hopper are fluidically connected to each other.

8. The spreader and sprayer of claim 1 wherein said first and second tanks on both said sides of said hopper are vented to atmosphere.

9. The spreader and sprayer of claim 1 wherein said manifold is positioned mid-length and mid-width of said spreader and sprayer.

10. A snow and ice control spreader and sprayer comprising:

a granular material hopper, an auger drive or a chain drive that conveys the granular material from said hopper to a spinner which broadcasts the granular material onto a road surface, at least first and second liquid tanks mounted on both sides of said hopper, said first tank having a first volume and said second tank having a second volume, said first volume being greater than said second volume, a pump and associated tubing which pumps the liquid from said tanks to a spray boom which sprays the liquid onto a road surface, and a manifold comprising:

a housing, said housing having an inlet for filling the tanks and an outlet for emptying the tanks, said outlet fluidically connected to said pump and associated tubing, and said housing having a first pair of first and second fittings, said first fitting of said first pair fluidically connected to said first tank on one side of said hopper and said second fitting of said first pair fluidically connected to said second tank on said one side of said hopper, and said housing having a second pair of said first and second fittings, said first fitting of said second pair fluidically connected to said first tank on the other side of said hopper and said second fitting of said second pair fluidically connected to said second tank on said other side of said hopper, said first fittings of said first and second pairs each having a first orifice, said second fittings of said first and second pairs each having a second orifice, said second orifice being smaller than said first orifice.

11. The spreader and sprayer of claim 10 wherein said housing includes a diverter between said inlet and said outlet for directing liquid from said inlet to said fittings.

12. The spreader and sprayer of claim 10 wherein said first tank has a length of 4 feet and said second tank has a length of 3 feet, and wherein said first tank and said second tank have the same width and depth.

13. The spreader and sprayer of claim 10 wherein said second orifice is defined by a washer positioned in each of said second fittings.

14. The spreader and sprayer of claim 10 wherein adjacent ones of said first and second tanks on said one side of said hopper are fluidically connected to each other and adjacent ones of said first and second tanks on said other side of said hopper are fluidically connected to each other.

15. The spreader and sprayer of claim 10 wherein said first and second tanks on both said sides of said hopper are vented to atmosphere.

16. The spreader and sprayer of claim 10 wherein said manifold is positioned mid-length and mid-width of said spreader and sprayer.

17. A snow and ice control spreader and sprayer comprising:

a granular material hopper, an auger drive or a chain drive that conveys the granular material from said hopper to a spinner which broadcasts the granular material onto a road surface, at least first and second liquid tanks mounted on both sides of said hopper, said first tank having a first volume and said second tank having a second volume, said first volume being greater than said second volume, a pump and associated tubing which pumps the liquid from said tanks to a spray boom which sprays the liquid onto a road surface, and a manifold comprising:

a housing, said housing having an inlet for filling the tanks and an outlet for emptying the tanks, said outlet fluidically connected to said pump and associated tubing, and said housing having a first pair of first and second fittings, said first fitting of said first pair fluidically connected to said first tank on one side of said hopper and said second fitting of said first pair fluidically connected to said second tank on said one side of said hopper, and said housing having a second pair of said first and second fittings, said first fitting of said second pair fluidically connected to said first tank on the other side of said hopper and said second fitting of said second pair fluidically connected to said second tank on said other side of said hopper, said first fittings of said first and second pairs each having a first orifice, said second fittings of said first and second pairs each having a second orifice, said second orifice being smaller than said first orifice, wherein adjacent ones of said first and second tanks on said one side of said hopper are fluidically connected to each other and adjacent ones of said first and second tanks on said other side of said hopper are fluidically connected to each other, and wherein said first and second tanks on both said sides of said hopper are vented to atmosphere.

18. The spreader and sprayer of claim 17 wherein said housing includes a diverter between said inlet and said outlet for directing liquid from said inlet to said fittings.

19. The spreader and sprayer of claim 17 wherein said first tank has a length of 4 feet and said second tank has a length of 3 feet, and wherein said first tank and said second tank have the same width and depth.

20. The spreader and sprayer of claim 17 wherein said second orifice is defined by a washer positioned in each of said second fittings.

21. The spreader and sprayer of claim 17 wherein said manifold is positioned mid-length and mid-width of said spreader and sprayer.

22. A snow and ice control sprayer comprising:

at least first and second liquid tanks mounted on both sides of said sprayer, said first tank having a first volume and said second tank having a second volume, said first volume being greater than said second volume, a liquid delivery system, and a manifold comprising:

a housing, said housing having an inlet for filling the tanks and an outlet for emptying the tanks, said outlet fluidically connected to said liquid delivery system, and said housing having a first pair of first and second fittings, said first fitting of said first pair fluidically connected to said first tank on one side of said sprayer and said second fitting of said first pair fluidically connected to said second tank on said one side of said sprayer, and said housing having a second pair of said first and second fittings, said first fitting of said second pair fluidically connected to said first tank on the other side of said sprayer and said second fitting of said second pair fluidically connected to said second tank on said other side of said sprayer, said first fittings of said first and second pairs each having a first orifice, said second fittings of said first and second pairs each having a second orifice, said second orifice being smaller than said first orifice.

23. The sprayer of claim 22 wherein said liquid delivery system comprises a pump and associated tubing which pumps the liquid from said tanks to a spray boom which sprays the liquid onto a road surface.

24. The sprayer of claim 22 wherein said housing includes a diverter between said inlet and said outlet for directing liquid from said inlet to said fittings.

25. The sprayer of claim 22 wherein said first tank has a length of 4 feet and said second tank has a length of 3 feet, and wherein said first tank and said second tank have the same width and depth.

26. The sprayer of claim 22 wherein said second orifice is defined by a washer positioned in each of said second fittings.

27. The sprayer of claim 22 wherein adjacent ones of said first and second tanks on said one side of said sprayer are fluidically connected to each other and adjacent ones of said first and second tanks on said other side of said sprayer are fluidically connected to each other.

28. The sprayer of claim 22 wherein said first and second tanks on both said sides of said sprayer are vented to atmosphere.

29. The sprayer of claim 22 wherein said manifold is positioned mid-length and mid-width of said sprayer.

* * * * *